US005292134A

United States Patent [19]

Schlundt et al.

[11] Patent Number: 5,292,134

[45] Date of Patent: Mar. 8, 1994

[54] BALL CATCHING AND LAUNCHING TOY

[75] Inventors: David Schlundt, Hermosa Beach; Gregory Cannone, Redondo Beach; John N. Handy, Long Beach, all of Calif.

[73] Assignee: Mattel, Inc., El Segundo, Calif.

[21] Appl. No.: 930,947

[22] Filed: Aug. 17, 1992

[51] Int. Cl.[5] ..... A63B 65/12

[52] U.S. Cl. ..... 273/324; 124/65; 273/326

[58] Field of Search ..... 273/318, 322, 323, 324, 273/325, 326, 327, 328; 124/64, 65, 66, 67, 68

[56] References Cited

U.S. PATENT DOCUMENTS

| | | | |
|---|---|---|---|
| 73,006 | 1/1868 | Hawkins | 273/324 |
| 710,359 | 9/1902 | Horton | 124/64 |
| 721,953 | 3/1903 | Holmstrom | 273/323 |
| 1,171,197 | 2/1916 | Harmon, Jr. | 124/65 |
| 1,210,847 | 1/1917 | Rubel | 273/324 |
| 2,029,790 | 2/1936 | Phillipp | 273/326 |
| 2,449,187 | 9/1948 | Walters | 124/65 |
| 2,670,958 | 3/1954 | Leiser et al. | 273/326 |
| 2,710,753 | 6/1955 | Lockwood | 273/326 |
| 3,702,702 | 11/1972 | Hoult | 273/326 |
| 3,766,902 | 10/1973 | Repinski | 124/65 |
| 3,822,062 | 7/1974 | Tucker et al. | 273/326 |
| 3,905,088 | 9/1975 | Tucker et al. | 273/326 |
| 4,084,820 | 4/1978 | Olson, Jr. | 273/324 |
| 4,153,251 | 5/1979 | Pond | 273/326 |
| 4,892,081 | 1/1990 | Moormann | 124/65 |
| 5,018,746 | 5/1991 | Cardoza, Jr. et al. | 273/326 X |
| 5,058,561 | 10/1991 | Starr | 124/65 |
| 5,113,842 | 5/1992 | Moormann | 124/65 |
| 5,115,794 | 5/1992 | Moormann | 124/65 |

*Primary Examiner*—William H. Grieb
*Attorney, Agent, or Firm*—Roy A. Ekstrand

[57] ABSTRACT

A ball catching and launching toy includes an elongated cylinder having a cylindrical bore defined therein. A catch scoop defining a generally concave catching surface is coupled to one end of the cylinder by a tapered funnel guide portion. The remaining of the cylinder receives a slidable handle having a piston rod and piston secured thereto. The piston rod and piston are movable within the cylinder bore to either produce a partial vacuum with the cylinder bore or increased pressure. Once a ball has been successfully captured by the user, the toy is raised to a generally vertical orientation and the handle is withdrawn from the cylinder producing a partial vacuum which urges the ball into a ball receptacle. The ball may then be launched or fired from the toy by rapidly forcing the handle inwardly producing pressurized air within the cylinder bore and ball receptacle which expels the captive ball.

10 Claims, 2 Drawing Sheets

10
11
12
13
14
15
16
17
18
19
20
21
22
23
24
30
31

10
11
12
13
14
16
18
19
23
25
26
40
41
42
43
50
51
52
60
61
62
70
71
72
73
75

40
41
43
51
60
61
62
63

5
5
10
11
14
16
19
40
41
42
43
51
53
60
61
62
70
71
72
73
75

10
11
14
16
19
40
41
42
43
51
60
61
70
71
72
73
75
80
81
82
83
84

BALL CATCHING AND LAUNCHING TOY

FIELD OF THE INVENTION

This invention relates generally to toys used in combination with a ball and particularly to catching toys used therewith.

BACKGROUND OF THE INVENTION

Perhaps one of the most popular types of toys used through the years is that known generally as ball launching toys or simply ball guns. While a variety of such toys having different shapes and configurations have been provided through the years, all generally include a common structure in which a cylindrical barrel defines an interior bore or ball receiving chamber for receiving one or more launchable projectile balls. In most cases, a movable plunger is provided which may be moved rapidly within a plunger cylinder to produce a pressurized air burst which forces the ball outwardly from the ball gun in a firing action. A front seal is usually provided near the end of the ball chamber or bore to restrain the ball as air pressure builds to plunger motion until the seal restraint is overcome giving the ball a popping action or sudden launch.

Ball launching toys or ball guns have been provided which operate with either noncompressible balls such as table tennis balls or the like as well as compressible foam balls having resilient compressible bodies.

U.S. Pat. No. 4,892,081 issued to Moormann sets forth a COMPRESSIBLE BALL LAUNCHER for use with a compressible closed cell foam ball. The launcher defines a ball quantity having a diameter generally larger than the foam ball for receiving a to-be-launched ball. The cavity defines a front constriction and is coupled to an air cylinder within which a plunger is movable. The ball is launched by rapidly moving the plunger forward compressing the air within the cylinder and ball chamber and forcing the ball against the front constriction in a sealing manner. As the pressure within the cylinder builds, the restraining force of the constriction is overcome and the ball is launched.

U.S. Pat. No. 5,113,842 issued to Moormann, sets forth a RAPID FIRE BALL LAUNCHER for launching a plurality of soft closed cell plastic compressible balls one at a time. An elongated ball receiving chamber defines a front constriction and a rear opening coupled to a cylinder. A plunger is movable within the cylinder to provide pressurized air within the ball chamber. A spring biased ball carriage is movable within the ball chamber and urges the plurality of balls within the chamber forwardly forcing the frontmost ball against the front seal. Thereafter, a rapid pressurization of the ball chamber is produced by plunger motion forcing the outermost ball outwardly in a firing or launching action.

U.S. Pat. No. 4,084,820 issued to Olson, Jr. sets forth a JET LAUNCH TOY consisting of a jet launching tube defining a cylindrical bore therethrough together with a launchable missile. The jet launching tube includes a funnel-shaped catching arrangement having a backboard or diverting surface secured thereto. In one play pattern, a light ball such as a table tennis ball may be received within or caught within the funnel-shaped catching portion and caused to settle at the upper opening of the launching tube. Thereafter, a rapid hand strike at the opposite end of the launch tube with a cup hand configuration causes the ball to be launched. The outer surface of the backboard defines a hitting surface which may be used to strike a ball launched by another player as an alternative to catching the ball.

While the foregoing described prior art devices have provided some enjoyment and amusement for users, there remains a continuing need in the art for evermore interesting and exciting ball launching toys and the like.

SUMMARY OF THE INVENTION

Accordingly, it is general object of the present invention to provide an improved ball launching toy. It is a more particular object of the present invention to provided an improved ball launching toy which facilitates the catching and return firing of freefailing through the air.

In accordance with the invention, there is provided a ball catching and launching toy for use in combination with a compressible ball comprises: a cylinder body defining cylinder bore therein; a piston and piston rod movable within the cylinder bore; a catching receptacle having a concave portion and a tapered portion coupled to the cylinder; and a ball receptacle defining a ball cavity supported between the tapered portion and the cylinder; the catching receptacle being used to capture the ball in flight and direct it into the tapered portion as the toy is vertically oriented whereby the ball may then be drawn into the ball receptacle and launched therefrom by piston motion.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figures 1, 2:
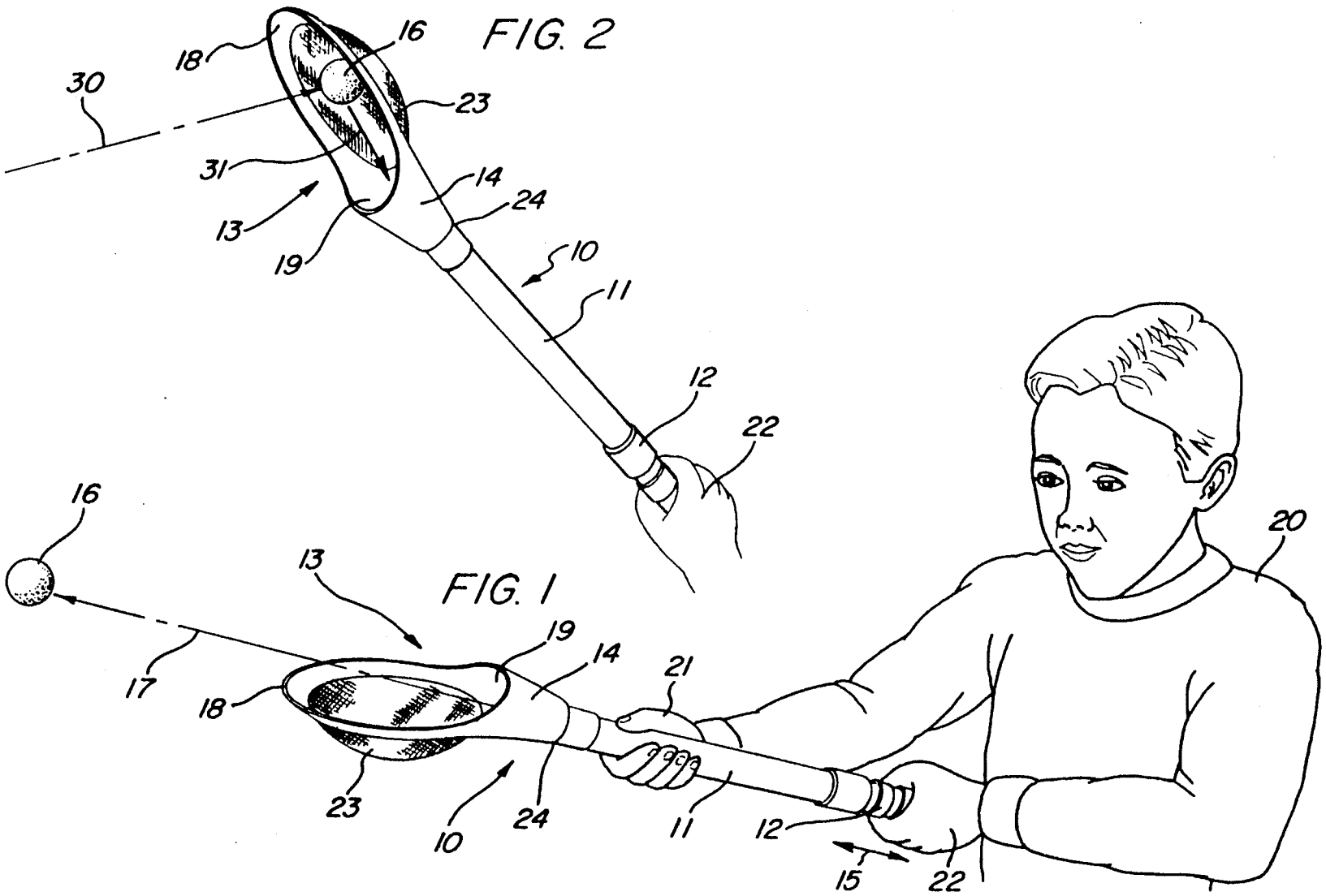
FIG. 1 sets forth a perspective view of a ball catching and launching toy constructed in accordance with the present invention in a launching operation by a typical user.
FIG. 2 sets forth a partial perspective view of the present invention ball catching and launching toy being used in a catching operation.

FIG. 1 sets forth a perspective view of a ball catching and launching toy constructed in accordance with the present invention and generally referenced by numeral 10. Toy 10 includes an elongated generally cylindrical cylinder 11 having a head portion 13 secured to one end and a movable handle 12 secured to the remaining end. In accordance with the structure set forth below in greater detail, handle 12 is slidably movable with respect to cylinder 11 and controls the motion of an internal piston within cylinder 1 shown and described below in FIG. 3 in greater detail. However, suffice it to note here that handle 12 is movable outwardly from cylinder 11 to draw into cylinder 11 and is movable inwardly to force air into cylinder 11. Head portion 13 includes an open generally concave catching scoop portion 10 together with a tapered funnel guide 14. Funnel guide 14 defines a tapered passage 19 having an interior conical surface.

A user 20 is shown operating toy 10 by grasping cylinder 11 in hand 21 while simultaneously grasping handle 12 using hand 22. Thereafter, the user is able to launch a ball 16 from a position within funnel guide 14 (better seen in FIG. 4) by rapidly forcing handle 12 forwardly to move toward cylinder 11. By means set forth below in greater detail, the rapid motion of handle 12 with respect to cylinder 11 produces pressurized air within cylinder 11 forcing ball 16 outwardly along launch path 17. In addition to its ball launching capability, toy 10 may be utilized to capture or catch ball 16 when returned from another player or otherwise toward user 20.

FIG. 2 sets forth a perspective view of toy 10 used in the ball catching or capturing operation of the present invention. As described above, toy 10 includes a cylinder 11 having a head portion 13 supported at one end thereof and a movable handle 12 supported at the remaining end thereof. Head 13 defines a funnel guide 14 and an open face generally concave catch scoop 18. In its preferred form, scoop 18 includes a mesh portion 23 which facilitates the catching process and renders head 13 easier to move through reduced hair resistance. In the position shown in FIG. 2, user hand 22 is shown grasping handle 12 and extending toy 10 upwardly to position catch scoop 18 within the travel path 30 of ball 16. With the exercise of some skill, the user is able to position toy 10 such that catch scoop 18 is positioned within travel path 30 of ball 16 and thus ball 16 impacts mesh portion 23 of catch scoop 18 and is deflected downwardly along the direction indicated by arrow 31 toward tapered passage 19. When properly manipulated, toy 10 is positioned within path 30 of ball 16 such that the downward deflection directs ball 16 into the interior of funnel guide 14 such that tapered passage 19 receives ball 16 and guides ball 16 to the narrow portion 24 of funnel guide 14.

Once ball 16 is successfully captured preferably while toy 10 remains in the upwardly pointed position shown in FIG. 2, the user may complete the capture of ball 16 by grasping cylinder 11 and drawing handle 12 outwardly from cylinder 11. By means set forth below in greater detail, this drawing motion of handle 12 with respect to cylinder 11 produces a drawing force upon ball 16 which pulls ball 16 into a prelaunch position in which ball 16 is partially captivated at the end of cylinder 11. Thereafter, ball 16 may be launched in the manner shown in FIG. 1 and described above by the user through simply thrusting handle 12 inwardly to produce pressurized air against ball 16 and launch ball 16 outwardly.

This play pattern is particularly advantageous when a pair of players each having toys constructed in accordance with the present invention are able to participate in a novel game of "catch" in which ball 16 is alternately captured and launched by each player in a back and forth game of catch.

Figure 3:
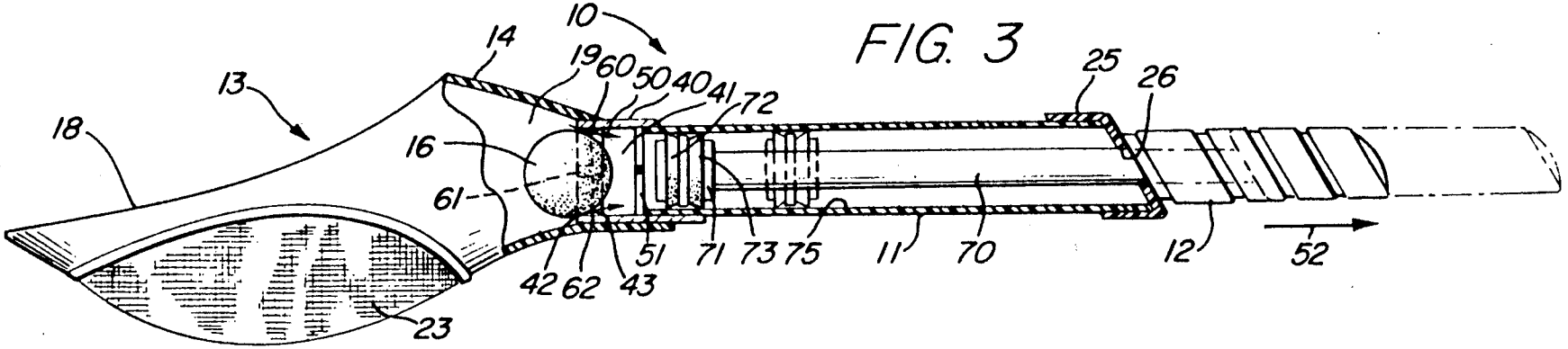
FIG. 3 sets forth a partially sectioned side view of the present invention ball catching and launching toy.

FIG. 3 sets forth a partially sectioned view of the present invention ball catching and launching toy. Toy 10 includes a generally cylindrical handle 11 defining an interior bore 75. An end cap 25 defining an aperture 26 is secured to cylinder 11 in accordance with conventional fabrication techniques such as thermal welding or adhesive bonding or the like. An elongated generally cylindrical piston rod 70 is secured to handle 12 and extends through aperture 26 into bore 75. A piston 71 having a two-way piston valve seal 72 and 73 is secured to the interior end of piston rod 70. A generally cylindrical ball receptacle 40 defines a ball cavity 41 and is secured to the outer surface of cylinder 11 in accordance with conventional fabrication techniques. Ball receptacle 40 defines an open throat portion 42 and an inwardly extending constriction 43. As is better seen in FIG. 5, constriction 43 defines a plurality of air slots 60, 61, 62 and 63 which extend through constriction 43. A cruciform shaped ball stop 51 is received within ball cavity 41 and is secured to ball receptacle 40 at the end portion of cylinder 11.

A head portion 13 includes a tapered funnel guide 14 secured to the outer surface of ball receptacle 40 in accordance with conventional fabrication techniques. Funnel guide 14 includes an interior tapered passage 19 tapering inwardly to generally coincide with throat 42 at its narrowest point. Head 13 further includes a generally concave catch scoop 18 having a mesh portion 23 and being continuously formed with funnel guide 14.

In operation, in the manner shown in FIG. 2, the user having successively captured ball 16 within funnel guide 14 maintains ball catching and launching toy 10 in a generally vertical orientation as shown in FIG. 2. For purposes of convenience, FIG. 3 is horizontally disposed, however, it should be understood that FIG. 3 depicts the operation of the present invention ball catching and launching toy when maintained in the raised generally vertical position shown in FIG. 2. Thus, under the influence of gravity, ball 16 moves downwardly into tapered passage 19 of funnel guide 14 and is, as a result, positioned at throat 42 of ball receptacle 40 in the position shown in FIG. 3. Once ball 16 has been positioned at throat 42, the user is able to grasp cylinder 11 in one hand and handle 12 in the remaining hand and draw handle 12 outwardly from cylinder 11 in the direction indicated by arrow 52. The rapid motion of handle 12 in the direction of arrow 52 draws piston 71 in a corresponding motion which in turn produces a partial vacuum within ball cavity 41 and cylinder bore 75. As a result of this partial vacuum, a quantity of air is drawn through air slot 60 through 63 in the direction indicated by arrows 50. Concurrently, the partial vacuum created within ball cavity 41 exerts a drawing force upon ball 16 drawing ball 16 inwardly to ball cavity 41 and compressing it upon constriction 43. As the drawing motion of handle 12 and piston 71 continues, ball 16 is compressed and deformed and is drawn past constriction 43 until it abuts ball stop 51.

Figure 4:
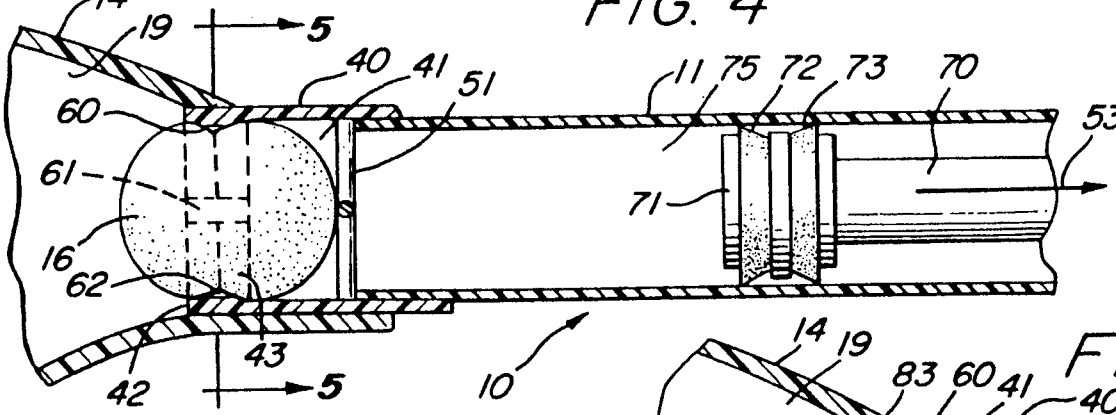
FIG. 4 sets forth a partial section view of the ball launching portion of the present invention toy.

FIG. 4 sets forth a partial section view of ball 16 during the above-described drawing operation as ball 16 is drawn into the ball launching position. As described above, toy 10 includes a funnel guide 14 defining a tapered passage 19. A ball receptacle 40 defines a ball cavity 41 and a constriction 43. Ball receptacle 40 further defines a throat portion 42 and a plurality of air slots 60 through 63 formed within constriction 43. A ball stop 51 is positioned within ball cavity 41. Cylinder 11 is received within and secured to ball receptacle by conventional attachment techniques and defines an interior bore 75. A piston rod 70 and piston 71 having seals 72 and 73 supported thereon is movable within bore 75.

In the position shown in FIG. 4, piston rod 70 and piston 71 are moving outwardly in the direction indicated by arrow 53 as the user draws handle 12 from cylinder 11 (seen in FIG. 3). The drawing motion of piston 71 produces a drawing force against ball 16 pulling ball 16 partially beyond constriction 43 and into ball cavity 41 of ball receptacle 40. During this drawing motion, the air passing through slots 60 through 63 of constriction 43 facilitates the drawing motion of piston 71 and piston rod 70.

At this point, ball 16 is fully loaded into ball receptacle 40 and is captivated within ball cavity 41 by the compression of the ball portion surrounded by constriction 43 and the interior confining surface of ball cavity 41. Ball stop 51 limits the inward movement of ball 16. The cruciform shape of ball stop 51, however, freely permits the passage of air between ball cavity 41 and bore 75 of cylinder 11.

Figure 5:
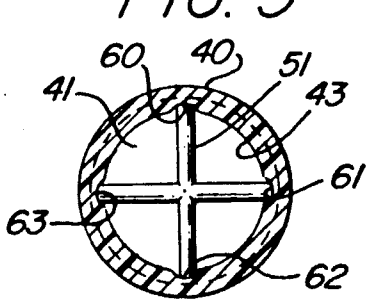
FIG. 5 sets forth a section view of the present invention ball catching and launching toy taken along section lines 5—5 in FIG. 4.

FIG. 5 sets forth a section view of toy 10 taken along section lines 5—5 in FIG. 4. For purposes of illustration, ball 16 is omitted from FIG. 5. As described above, ball receptacle 40 defines an inwardly extending generally annular constriction 43 having a plurality of air slots 60 through 63 formed therein. As is also described above, ball stop 51 defines a generally cruciform-shaped member which facilitates the passage of air to and from ball cavity 41.

Figure 6:
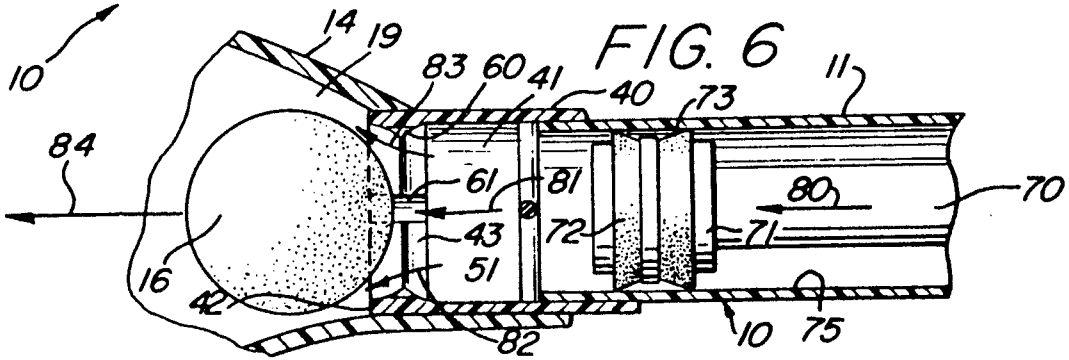
FIG. 6 sets forth a partially sectioned view of the ball launching portion of the present invention toy following the launch of a compressible ball.

FIG. 6 sets forth a partial section view of toy 10 following the execution of the above-described ball launching process. As is set forth above, toy 10 includes a cylinder 11 having a bore 75 formed therein. A ball receptacle 40 defines a ball cavity 41 within which a cruciform-shaped ball stop is supported. Head portion 13 includes a funnel guide 14 which is received upon and secured to ball receptacle 40 in accordance with conventional fabrication techniques. Ball receptacle 40 also defines a throat portion 42. A movable piston rod 70 supports a piston 71 having a pair of seals 72 and 73 secured thereto. Piston 71 is movable within bore 75 in response to the user's manipulation of handle 12 and piston rod 70 (seen in FIG. 3).

In operation, the launch of ball 16 is undertaken once ball 16 has been drawn into ball cavity 41 of ball receptacle 40 in the manner shown in FIG. 4. Thereafter, user rapidly moves handle 12 toward cylinder 11 drivinq piston 71 forwardly in the direction indicated by arrow 80 causing the air within bore 75 and ball cavity 41 between ball 16 and piston 71 to become pressurized. As piston 71 continues to move in the direction indicated by arrow 80, the pressure within ball cavity 41 and the portion of bore 75 ahead of piston 71 increases sharply producing an increased force against ball 16 tending to urge ball 16 outwardly from ball receptacle 40. Initially, the resilient force of compressible ball 16 causes ball 16 to be held firmly by constriction 43. As piston 71 continues to be driven inwardly, however, the pressure within ball cavity 41 overcomes the restraining force of constriction 43 forming ball 16 outwardly in the direction indicated by arrow 84. During this expulsion of ball 16, some air passes outwardly through ar slot 60 through 63. The bulk of the air pressurized within ball cavity 41, however, flows outwardly behind ball 16 in the manner indicated by arrows 81 through 83. Ball 16, as a result, is launched outwardly and travels in a generally straight line launch in the direction indicated by arrow 84.

Thus, in accordance with the anticipated play pattern of the present invention ball catching and launching toy, the user is able to catcher or catch a resilient foam ball using the catch scoop portion of the present invention toy and thereafter raising the toy to a generally vertical orientation. As the toy is raised to a generally vertical orientation, the ball falls downwardly through the frontal shape guide portion to be received at the throat portion of the ball receptacle. Thereafter, while still maintaining the present invention in a generally vertical orientation, the user is able to load the ball into the ball receptacle by drawing the slidable handle outwardly from the cylinder. Once the ball has been loaded into the ball receptacle, it is captivated therein by the constriction formed within the ball receptacle. Thus, once the ball has been loaded, vertical orientation of the present invention ball catching and launching toy is no longer required and the toy may be aimed in a horizontal or even downwardly angled orientation as the player prepares to fire the ball.

The ball firing is achieved by rapidly forcing the slidable handle into the cylinder body producing pressurized air within the ball receptacle which expels the captive ball with a loud popping noise. The expelled ball travels outwardly from the catch scoop portions in a generally straight line path.

Thus, the user to able to both skillfully catch and capture the ball as well as aim and launch the ball in a pressurized air launch operation.

What has been shown is a novel ball catching and launching toy which facilitates the catching or capture of a freeflying compressible foam ball which may thereafter be loaded into a firing position by the user and fired outwardly from the toy as the user aims and directs.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A ball catching and launching toy for use in combination with a compressible ball comprising:
   - a cylinder body defining a cylinder bore therein;
   - a piston and piston rod movable within said cylinder bore;
   - a catching receptacle having a concave portion and a tapered portion coupled to said cylinder; and
   - a ball receptacle defining a ball cavity supported between said tapered portion and said cylinder and having means for captivating said ball at least partially within said ball receptacle when said ball is drawn therein;
   - said catching receptacle being used to capture said ball in flight and direct it into said tapered portion as said toy is vertically oriented whereby said ball may then be drawn into said ball receptacle and launched therefrom by piston motion.

2. A ball catching and launching toy as set forth in claim 1 wherein said ball receptacle defines an inwardly extending constriction forming said means for captivating.

3. A ball catching and launching toy as set forth in claim 2 wherein said constriction defines a plurality of slots extending therethrough.

4. A ball catching and launching toy as set forth in claim 3 further including a handle secured to said piston rod external to said cylinder body at the opposite end thereof from said piston.

5. A ball catching and launching toy as set forth in claim 4 wherein said ball receptacle includes a ball stop supported within said ball receptacle and spaced from said constriction by a distance less than the diameter of said ball.

6. A ball catching and launching toy as set forth in claim 5 wherein said cylinder body defines a major axis and wherein said catching receptacle defines a curved edge extending from said tapered portion at an angle to said major axis.

7. For use in combination with a compressible ball, a ball catching and launching toy comprising:

a cylindrical body defining first and second ends, a major axis, and a cylinder bore;

a piston sealingly fitted within said cylinder bore;

a piston rod coupled to said piston and extending outwardly from said cylinder bore beyond said second end;

a ball receptacle defining a ball cavity coupled to said first end of said cylindrical body defining an inwardly extending constriction spaced from said first end of said cylindrical body; and a catching scoop having a concave open-sided portion and a tapered portion coupled to said ball receptacle.

8. A ball catching and launching toy as set forth in claim 7 wherein said ball receptacle includes a ball stop spaced from said constriction by a distance less than the diameter of said ball.

9. A ball catching and launching toy as set forth in claim 8 wherein said catching scoop defines an edge portion extending about said tapered portion and traversing said major axis of said cylindrical body at an acute angle such that said ball when captive in said ball receptacle may be launched by piston motion toward said ball outwardly through said tapered portion and past said edge.

10. A ball catching and launching toy for use in combination with a compressible ball comprising:

a ball catching receptacle having a concave portion and a tapered portion;

a ball receptacle coupled to said tapered portion defining a ball cavity configured to receive at least a portion of said compressible ball in a captive retention resisting removal of said ball; and air suction and pressure means, coupled to said ball receptacle, for producing a suction to draw said ball at least partially into said ball cavity and for producing an air pressure to expel said ball therefrom.

* * * * *